United States Patent [19]

Rivere

[11] 3,982,505

[45] Sept. 28, 1976

[54] CIRCUITRY FOR CONTROLLING THE RESPONSE TIME OF ELECTROMAGNETIC DEVICES WITH A SOLENOID

[75] Inventor: Jean-Pierre Rivere, Paris, France

[73] Assignee: Regie Nationale des Usines Renault, Boulogne-Billancourt, France

[22] Filed: Sept. 5, 1974

[21] Appl. No.: 503,460

[30] Foreign Application Priority Data

Sept. 5, 1973 France ..... 73.32080

[52] U.S. Cl. ..... 123/32 EA; 317/DIG. 4; 317/123; 317/148.5 R

[51] Int. Cl.[2] ..... F02B 3/00

[58] Field of Search ..... 123/32 CA; 317/DIG. 4, 317/DIG. 6, 157, 123, 151, 148.5

[56] References Cited

UNITED STATES PATENTS

| | | | |
|---|---|---|---|
| 3,433,207 | 3/1969 | Bassot | 123/32 EA |
| 3,465,731 | 9/1969 | Bassot | 123/32 CA |
| 3,634,733 | 1/1972 | Boyer | 317/148.5 |
| 3,702,425 | 11/1972 | Hoffmann | 317/DIG. 4 |

*Primary Examiner*—Charles J. Myhre
*Assistant Examiner*—Ronald B. Cox
*Attorney, Agent, or Firm*—Oblon, Fisher, Spivak, McClelland & Maier

[57] ABSTRACT

A method for controlling the response time of an electromechanical device having an actuating solenoid comprising: applying three reference voltages from three reference voltage sources in a predetermined order to a voltage and current amplifier which drives the solenoid, generating from the three reference voltages three corresponding currents through the solenoid, the three currents being a premagnetization current, a maximum activation current of the solenoid and a deactivation current of the solenoid.

6 Claims, 3 Drawing Figures

CIRCUITRY FOR CONTROLLING THE RESPONSE TIME OF ELECTROMAGNETIC DEVICES WITH A SOLENOID

BACKGROUND OF THE INVENTION

1. Field of the Invention

The present invention concerns circuitry for controlling current in order to control the response time of electromagnetic devices having a solenoid to drive the electromagnetic injectors of an injection system for internal combustion engines. This control is realized using reference voltage sources which determine different levels of the driving current of the solenoid.

2. Description of the Prior Art

The problem posed by the control of solenoids, particularly fast-acting ones such as the electromagnetic injector solenoids of an internal combustion engine injection system, is to control the electrical response time of the solenoid command.

Arrangements are known for controlling solenoids with regulated command voltage, but these arrangements do not permit obtaining constant driving currents since they do not compensate for variation in coil resistance during temperature changes.

There are also known controls with constant current which are much less expensive than those with constant voltage and which allow control of the magnetic force exerted by the solenoids in the steady state. However, such controls do not permit obtaining an electrical response time independent of the supply voltage of the control electronics, thus requiring the regulation of the supply voltage.

SUMMARY OF THE INVENTION

The invention, therefore, has as one of its objects to improve the current control of a solenoid in order to control not only the maximum coil current but also to control the electrical response time of activation and deactivation independently of the supply voltage.

According to the invention, this object is attained through the use of control current circuitry which determines three levels of solenoid driving current.

In accordance with the invention, this control current circuitry is obtained through the use of a voltage-current converter amplifier driven by three reference voltage sources which are switched in a predetermined order by a group of electronic switches.

The different phases of this control circuitry will now be defined with reference to FIG. 1 of the drawing.

From time t0 to time t1: this is phase no. 1. which is termed the premagnetization phase. It permits reduction of the electrical response time of the following phase (phase no. 2). The corresponding current through the solenoid, or premagnetization current, is termed Ip.

From t1 to t2: this is phase no. 2. This is the period of maximum excitation (or pull-in) of the solenoid. It is desired that the slope $\alpha$ of the current increase in the solenoid be independent of the supply voltage.

From t2 to t3: this is phase no. 3. The rise in current is halted when the desired peak current Im is reached (at the instant t2). However, it is not necessary to maintain this current for a long period, since, in general, the holding currents are significantly less than pull-in currents.

From t3 to t4: the current through the solenoid is decreased from Im to Id which is the minimum holding value of the energizing current. The variation in current between times t3 and t4 has no effect on the action of the electromagnetic device.

From t4 to t5: this is phase no. 4. During this phase the solenoid current is Id which is the demagnetization current.

From t5 to t6: this is phase no. 5. At a given instant t5, it is necessary to deactivate the solenoid in order to stop the action of the electromagnetic device. The driving voltage is reduced to zero during the short interval between t5 and t6. At the instant t6, the electronic control circuitry returns to the same condition as at time t0 in order to prepare for the pull-in current.

The relation among the three different excitation currents which has just been described is Ip<Id<Im.

The foregoing and other objects are attained in accordance with one aspect of the present invention.

Various objects, features and attendant advantages of the present invention will be more fully appreciated as the same becomes better understood from the following detailed description of the present invention when considered in connection with the accompanying drawings, in which.

Figure 3:
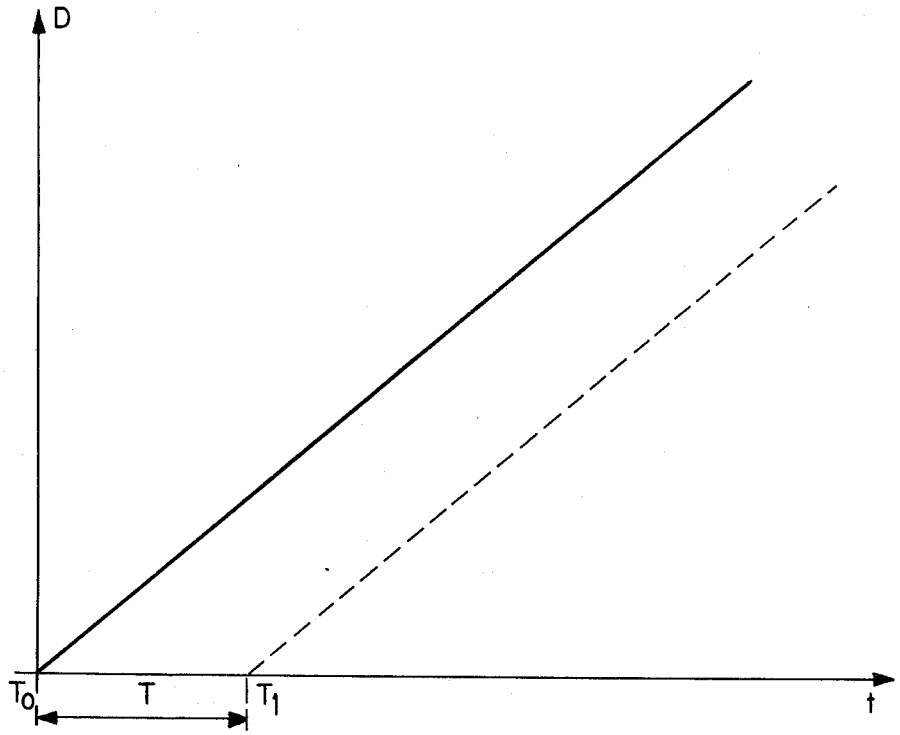

FIG. 3 compares the output characteristic of an injector controlled in the conventional way with the characteristics of the same injector controlled in accordance with the present invention.

Figure 2:
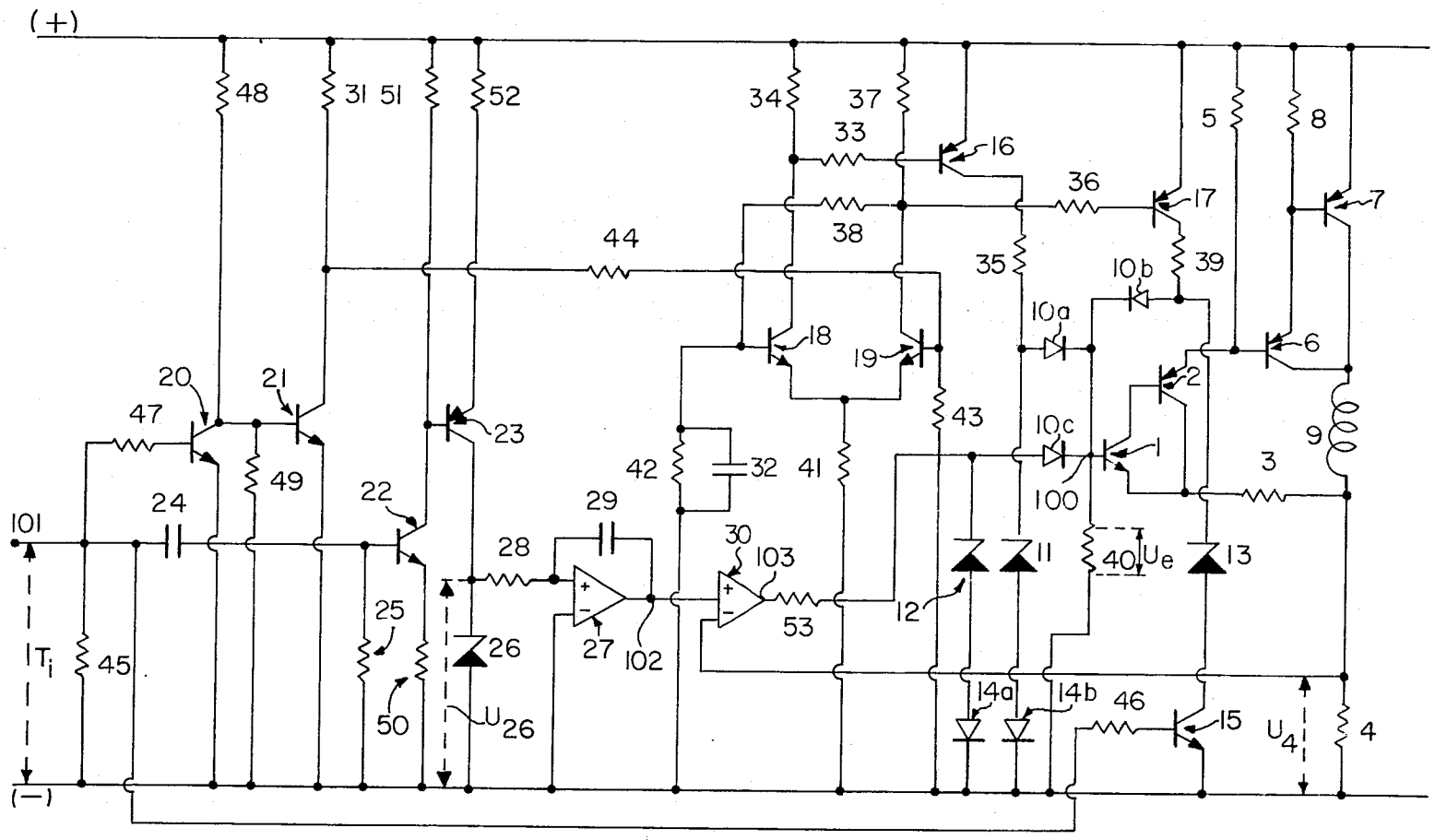
FIG. 2 is a schematic of circuitry in accordance with the invention.

With reference to FIG. 2, it is seen that the electronic circuit has essentially a voltage and current amplifier consisting of the two transistors 1 and 2 in an inverted DARLINGTON connection so as to partially compensate the voltage drop Vbe of transistor 1. The collector current Ic of transistor 2 is equal to the input voltage Ve applied to the base 100 of transistor 1 divided by the sum of the resistances 3 and 4 (transistor 7 being cut off). The emitter of transistor 2 is connected to the + supply line through a resistance 5, the main purpose of which is to decrease the response time of the DARLINGTON connection consisting of transistors 1 and 2. The current Ic serves to drive the transistors 6 and 7 which are also connected as a common-emitter DARLINGTON pair so that the collectors of these two transistors drive the solenoid 9 and the resistance 4 in the feedback circuit.

A resistance 8 ties the common point of the emitter of transistor 6 and the base of transistor 7 to the + supply line. The main purpose of resistance 8 is to decrease the response time of transistor 6. The resistances 5 and 8 also permit faster cut off of transistors 6 and 7.

The voltage V4 across resistance 4 is applied to the emitter of transistor 1 through resistance 3 (which serves to limit the current in transistor 1 when the voltage Ve is applied to its base 100) so that the DARLINGTON pair formed by transistors 1 and 2 acts as a comparator. Therefore the relation V4 = Ve is established and the current through the solenoid is equal to V4/R4 = Ve/R4. The current through the solenoid is therefore a function of Ve.

Three diodes 10*a*, 10*b* and 10*c* connect the cathodes of three Zener diodes 11, 12 and 13 to the base 100 of transistor 1 forming an inclusive OR circuit permitting successive application of the three voltages determined by the Zener diodes 11, 12 and 13. The respective Zener voltages V11, V12, V13 are:

V11 = R4 · Ip

V12 = R4 · Im

V13 = R4 · Id

The diodes 14*b* and 14*a* connecting the anodes of Zener diodes 11 and 12, respectively, to the (−) supply line together with transistor 15 whose emitter is tied to the (−) supply line compensate the voltage drop in diodes 10*a*, 10*b* and 10*c* of the OR gate so as to maintain the precision of the circuit and compensate for temperature drifts.

Figure 1:
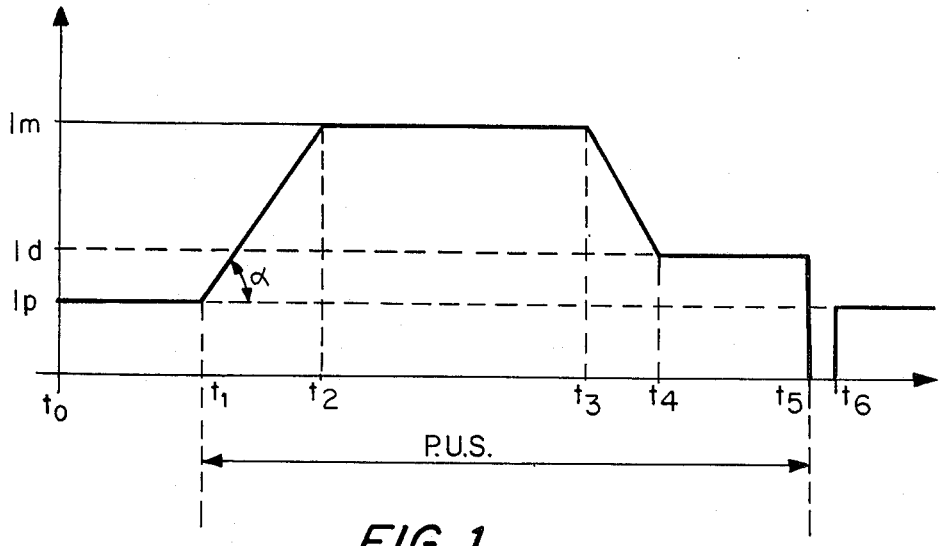
FIG. 1 is, as already explained, a diagram explaining the current control program. The abbreviation P.U.S. in the figure signifies the period of use of the solenoid.

There will now be described the manner in which this circuit permits realization of phases 1 and 4 described above and shown in FIG. 1.

Phases 1 and 4 represent an exclusive OR command. The Zener diodes 11 and 13 are therefore controlled in an all-or-nothing manner by transistors 16 and 17 forming a power stage between the Zener diodes 11 and 13 and the bistable circuit with preset steady state levels constituted by transistors 18 and 19.

The emitter of transistor 16 is tied directly to the + supply. Its base is connected through resistance 33 to the collector of transistor 18. The common point of resistance 33 and the collector of transistor 18 is connected through resistance 34 to the + supply. The collector of transistor 16 is connected through a resistance 35 to the Zener diode 11 as well as to the anode of diode 10*a* which is, as mentioned above, one of the diodes forming the aforementioned inclusive OR. The emitter of transistor 17 is tied directly to the + supply. Its base is connected through a resistance 36 to the collector of transistor 19. The common point of resistance 36 and the collector of transistor 19 is connected to the + supply by a resistance 37 and to the base of transistor 18 by a resistance 38. The collector of transistor 17 is connected by a resistance 39 to the cathode of Zener diode 13 and the anode of diode 10*b*. The cathode of Zener diode 12 is connected to the anode of diode 10*c*. The cathodes of diodes 10*a*, 10*b*, 10*c* which form the aforementioned inclusive OR are connected to the base 100 of transistor 1 which is connected through the resistance 40 to the (−) supply.

The emitters of transistors 18 and 19 constituting the aforementioned bistable circuit are tied together and connected by a common emitter resistance 41 to the (−) supply. the base of transistor 18 is also connected to the (−) supply by the capacitance 31 connected in parallel with the resistance 42. The base of transistor 19 is connected to the (−) supply by the resistance 43 and is connected to the collector of transistor 21 by the resistance 44. The common point of resistance 44 and the collector of transistor 21 is connected by a resistance 31 to the + supply.

The bistable circuit formed by transistors 18 and 19, with no input signal at the input 101, permits, by the intermediacy of transistors 20 and 21, the saturation of transistor 18 and the cut-off of transistor 19. Consequently, transistor 16 is saturated and the Zener diode 11 is also saturated (its Zener voltage being reached or exceeded). The current Ip then flows through solenoid 9.

The input 101 of the circuit is connected to the (−) supply by a resistance 45, to the base of transistor 15 by resistance 46, to the base of transistor 20 by resistance 47 and to the base of transistor 22 by a capacitor 24.

The emitter of transistor 20 is tied directly to the (−) supply while its collector is connected to the + supply by a resistance 48. The collector of transistor 20 is tied directly to the base of transistor 21 and is connected to the (−) supply by a resistance 49. The emitter of transistor 21 is tied directly to the (−) supply.

When the signal voltage Ti is applied to the input 101 of the circuit, transistor 19 is saturated, transistor 18 is cut off, and, therefore, Zener diode 11 comes out of saturation so as to saturate Zener diode 13 by the intermediacy of transistor 17 which is also saturated. The current Id then flows through solenoid 9.

It is established then that when the Zener voltage of Zener diode 11 is reached, the current Ip flows through the solenoid 9 and operating phase no. 1 is obtained. When the excitation voltage Ti is applied, the Zener voltage of Zener diode 13 is reached, current Id flows in solenoid 9 and phase no. 4 is obtained.

It will now be determined how operating phase no. 2 is attained. It has just been explained that when the excitation Ti is applied to the input 101 of the circuit, solenoid 9 is traversed by the current Ip. The time constant $\tau$ of the differentiating circuit made up of resistance 25 (between the base of transistor 22 and the (−) supply) and capacitor 24 saturates transistor 22 for a time equal at least to T′ where T′ $2\tau$ (T′ not having to be very precise).

The emitter of transistor 22 is connected by a resistance 50 to the (−) supply while its collector is connected to the + supply by resistor 51 and directly to the base of transistor 23. The emitter of transistor 23 is connected through resistor 52 to the + supply while its collector is tied to the cathode of Zener diode 26 whose anode is directly tied to the (−) supply. The collector of transistor 23 is also connected through a resistance 28 to the + input of an integrator 27. The output 102 of integrator 27 is connected to the + input of integrator 27 by capacitor 29 and is connected directly to the + input of a voltage comparator 30. The (−) input of integrator 27 is tied directly to the (−) supply. The (−) input of comparator 30 is tied to the common point of resistor 4, resistor 3 and solenoid 9. The output 103 of comparator 30 is connected by a resistance 53 to the common point of the cathode of Zener diode 12 and the anode of diode 10*c*.

Saturation of transistor 22 causes saturation of transistor 23 which causes saturation of Zener diode 26 whch furnishes a reference voltage V26 to integrator 27, the purpose of which is to transform the constant voltage V26 into a voltage V102 which increases linearly with time *t*:

$$V102 = \frac{V26}{R28 \cdot C29} t$$

The offset voltage of integrator 27 is made equal to V11 (V11 being the Zener voltage of Zener diode 11) in order to avoid electrical delays in the growth of current in solenoid 9, and is applied to comparator 30 in order to furnish constant voltage V12 to the input of the voltage and current amplifier consisting mainly of the transistors 1 and 2 as already described. When the voltage V4 developed across the resistance 4 becomes greater than V102 at a given instant *t*0, the voltage comparator 30 nullifies the voltage V12 to prevent too rapid an increase of current in solenoid 9. As V102 continues to increase to the instant *t*0 + *dt*0, V102 again becomes greater than V4 and the voltage V12 is again applied to the input of the voltage and current amplifier.

If the condition R28 · C29 > R4/L9 is realized, i.e. the voltage V102 increases slower than the voltage V4 (L9 being the self-inductance of solenoid 9), the current rise is controlled independently of all external conditions. Only the time constant $\tau = C24 \cdot R25$ determines the time during which it is desired that the rise in current in solenoid 9 be continued. The current Im is thus attained through the solenoid 9. When the time elapsed after the application of Ti to 101 exceeds about $2\tau$, the transistors 22 and 23 as well as the Zener diode 26 come out of saturation and the rise of voltage V102 is stopped which blocks the comparator 30 which desaturates Zener diode 12. However, since Ti is still applied, Zener diode 13 is saturated at this moment as has been described above with reference to the explanation of phases 3 and 4. The current through solenoid 9 is thus Id.

There will now be described the last phase of the cycle, i.e. phase no. 5. When the voltage Ti is removed, transistor 21 comes out of saturation so that the voltage across resistor 31 increases which allows transistor 19 to desaturate thereby removing the holding current. The condenser 32 prevents transistor 18 from saturating instantaneously to allow time for the holding current to die out completely in order to restore the premagnetization current Ip in solenoid 9.

In the case of control of electromagnetic injectors of automobile engine injection systems, this arrangement permits elimination of any influence of the vehicle's battery voltage on the response time of the injector, the output of which thus becomes completely independent of the supply voltage.

FIG. 3 shows the output characteristics of the same injector controlled with the arrangement of the present invention (solid line) as well as with the conventional method (dashed line). The abscissa in FIG. 3 is the time $t$ of lift of the needle and the ordinate is the output D per stroke of the injector. The time T between the instants $T_0$ and $T_1$ is the response time of the injector which is a function of the control voltage, where $T_0$ is the origin of the coordinates and $T_1$ is variable. There will thus be noted the simplification afforded by the arrangement of the present invention in comparison with the known type of arrangements.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A method for controlling the response time of an electromechanical device having an actuating solenoid comprising:

applying three reference voltages from three reference voltage sources in a predetermined order to a voltage and current amplifier which drives the solenoid;

generating from the three reference voltages three corresponding currents through the solenoid, the three currents being a premagnetization current, a maximum excitation current of the solenoid and a de-excitation current of the solenoid;

sending the premagnetization current through the solenoid during a first phase;

saturating a source of reference voltage located at the input of an integrator which transforms the constant voltage of the source into a voltage which increases linearly with time;

applying the linearly increasing voltage to the voltage and current amplifier;

sending a current which increases linearly to the maximum excitation current through the solenoid during a second phase;

maintaining the maximum excitation current through the solenoid during a third phase;

decreasing the current through the solenoid to de-excitation value at the end of the third phase;

maintaining the de-excitation current through the solenoid during a fourth phase; and reducing the current through the solenoid to zero during a fifth phase before the cycle is restarted by sending a premagnetization current through the solenoid.

2. The method recited in claim 1 including the step of comparing the output voltage of the integrator to a voltage proportional to the current through the solenoid.

3. A method for controlling the response time of an electromechanical device having an actuating solenoid comprising:

applying three reference voltages from three reference voltage sources in a predetermined order to a voltage and current amplifier which drives the solenoid, said voltage and current amplifier including two transistors in a Darlington circuit, and each of said three reference voltage sources including a Zener diode connected to the input of the voltage and current amplifier through diodes forming an inclusive OR function and switchable in a predetermined order by an array of semiconductor-type switches;

generating from the three reference voltages three corresponding currents through the solenoid, the three currents being a premagnetization current, a maximum excitation current of the solenoid and a de-excitation current of the solenoid;

sending the premagnetization current through the solenoid during a first phase;

sending a current which increases linearly to the maximum excitation current through the solenoid during a second phase;

maintaining the maximum excitation current through the solenoid during a third phase;

decreasing the current through the solenoid to a de-excitation value at the end of the third phase;

maintaining the de-excitation current through the solenoid during a fourth phase; and reducing the current through the solenoid to zero during a fifth phase before the cycle is restarted by sending the premagnetization current through the solenoid.

4. The method recited in claim 3 including the step of connecting to the voltage and current amplifier the output of an integrator circuit which receives the voltage of a fourth Zener diode, said integrator circuit comprising an integrating amplifier and an integration network with a resistor and a condenser.

5. The method recited in claim 3 including the steps of:

connecting one input of a comparator to the output of an integrator circuit which receives the voltage of a fourth Zener diode, said integrator circuit comprising an integrating amplifier and an integration network with a resistor and a condenser;

connecting the other input of the comparator to an element which supplies a voltage proportional to the current through the solenoid; and connecting the output of the comparator to the input of the voltage and current amplifier, whereby the current rise in the solenoid can be adjusted.

6. The method recited in claim 5 including the step of maintaining, with a differentiating circuit having a predetermined time constant and comprising a condenser and a resistor, the increase of a reference voltage for a time equal to at least twice the time constant.

* * * * *